US009722328B2

(12) United States Patent
Wimmer

(10) Patent No.: US 9,722,328 B2
(45) Date of Patent: Aug. 1, 2017

(54) CONTACT PART AND METHOD FOR PRODUCING A CONTACT PART

(71) Applicant: Lisa Draexlmaier GmbH, Vilsbiburg (DE)

(72) Inventor: Stefan Wimmer, Hohenthann (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/078,522

(22) Filed: Mar. 23, 2016

(65) Prior Publication Data

US 2016/0285178 A1 Sep. 29, 2016

(30) Foreign Application Priority Data

Mar. 24, 2015 (DE) ..... 10 2015 104 377

(51) Int. Cl.

| | |
|---|---|
| ***H01R 13/15*** | (2006.01) |
| ***H01R 4/48*** | (2006.01) |
| ***H01R 43/16*** | (2006.01) |
| ***H01R 13/193*** | (2006.01) |
| ***H01R 13/639*** | (2006.01) |
| *H01R 13/11* | (2006.01) |
| *H01R 13/187* | (2006.01) |
| *H01R 13/20* | (2006.01) |

(52) U.S. Cl.

CPC ..... *H01R 4/489* (2013.01); *H01R 13/193* (2013.01); *H01R 13/639* (2013.01); *H01R 43/16* (2013.01); *H01R 13/113* (2013.01); *H01R 13/187* (2013.01); *H01R 13/20* (2013.01)

(58) Field of Classification Search

CPC ..... H01R 12/89; H01R 12/87
USPC ..... 439/263, 839, 848, 845, 852, 787, 723
See application file for complete search history.

(56) References Cited

U.S. PATENT DOCUMENTS 2,075,632 A * 3/1937 Zuckerman ..... H01R 13/193 439/222
2,269,314 A * 1/1942 MacDonald ..... H01R 13/193 439/682

(Continued)

FOREIGN PATENT DOCUMENTS

DE 10 2012 002 145 A1 8/2013
JP H02-199780 A 8/1990

(Continued)

*Primary Examiner* — Neil Abrams
(74) *Attorney, Agent, or Firm* — Finnegan, Henderson, Farabow, Garrett & Dunner LLP

(57) ABSTRACT

Embodiments disclose a contact part comprising a sleeve forming a receiving space for inserting a plug-in contact in an insertion direction, at least one contact spring secured to the inside of the sleeve, and a locking pin configured to be displaceably guided in the sleeve between first and second end positions in sliding contact with the contact spring, wherein the locking pin is configured to push the contact spring in the direction of the receiving space to varying degrees depending on the position of the locking pin between the two end positions. Embodiments disclose a method for producing a contact part comprising providing a sheet metal part and at least one contact spring held in a form-locked manner in the sheet metal part, and forming the sheet metal part to obtain a sleeve that forms a receiving space for inserting a plug-in contact in the insertion direction.

20 Claims, 5 Drawing Sheets

(56) References Cited

U.S. PATENT DOCUMENTS 3,350,681 A * 10/1967 Benoit ..... H01R 13/193 439/837
3,596,229 A * 7/1971 Hohorst ..... H01R 4/4845 24/115 G
3,643,202 A * 2/1972 Coon ..... H01R 13/193 439/263
4,445,747 A * 5/1984 Neidich ..... H01R 13/35 439/723
4,637,677 A * 1/1987 Barkus ..... H01R 4/52 439/724
4,880,401 A * 11/1989 Shima ..... H01R 13/187 439/746
4,966,563 A * 10/1990 Pierce ..... H01R 25/142 439/729
4,973,271 A * 11/1990 Ishizuka ..... H01R 13/193 439/833
5,441,428 A 8/1995 Hamai et al.
5,551,884 A * 9/1996 Burkhart, Sr. ..... H01R 13/20 439/140
6,672,911 B2 * 1/2004 Zhao ..... H01R 13/187 439/271
7,294,027 B1 * 11/2007 Tyler ..... H01R 13/187 439/845
7,381,104 B2 * 6/2008 Rehbein ..... H01R 13/193 439/852
7,465,199 B2 * 12/2008 Osada ..... H01R 4/185 439/845
7,537,497 B2 * 5/2009 Tyler ..... H01R 13/187 439/843
7,670,197 B2 * 3/2010 Janulis ..... H01R 4/4818 439/441
7,976,353 B2 * 7/2011 Myer ..... H01R 13/04 439/891
8,579,634 B2 * 11/2013 Raquin ..... H01R 13/18 439/31
9,160,082 B2 * 10/2015 Heringhaus ..... H01R 13/187
9,236,675 B2 * 1/2016 Tsuji ..... H01R 13/187
9,246,243 B2 * 1/2016 Schuetz ..... H01R 4/4818
2002/0123275 A1 9/2002 Zhao et al.
2014/0329419 A1 11/2014 Heringhaus et al.
2016/0285178 A1 * 9/2016 Wimmer ..... H01R 4/489

FOREIGN PATENT DOCUMENTS

JP 2007-280729 A 10/2007
WO WO 2012/176936 A1 12/2012

* cited by examiner

CONTACT PART AND METHOD FOR PRODUCING A CONTACT PART

CROSS REFERENCE TO RELATED APPLICATION

This application is based upon and claims the benefit of prior German Patent Application No. 10 2015 104 377.7, filed on Mar. 24, 2015, the entire contents of which are incorporated herein by reference.

TECHNICAL FIELD

The present disclosure relates to a contact part comprising a sleeve that, on the inside, forms a receiving space for a plug-in contact to be inserted in an insertion direction. The present disclosure can be applied to high-current plug connections, in particular for vehicles and in onboard electrical systems of vehicles.

BACKGROUND OF THE DISCLOSURE

DE 10 2012 002 145 A1 discloses a sleeve contact for an electrical zero insertion force plug connector, comprising a base body, which forms a contact region for attaching a complementary electrical plug contact, and a clamping sleeve, which is arranged on the base body and displaceable with respect to the base body and which, in a sliding position for making contact with a plug contact inserted in the sleeve contact, applies a contact force on the contact region of the sleeve contact, wherein the clamping sleeve acts on a spring introduced into the base body as an added part. However, the sleeve contact includes a variety of drawbacks. For example, installation in a housing is difficult due to the clamping sleeve. It is difficult in particular to create installation space compatibility with existing plug connection geometries. Moreover, high vibration resistance is not ensured.

SUMMARY

Embodiments of the present disclosure provide a contact part, comprising a sleeve that, on the inside, forms a receiving space for a plug-in contact to be inserted in an insertion direction, at least one spring that is secured to the inside of the sleeve (also referred to herein as "contact spring"), a pin that can be displaceably guided in the sleeve between a first end position and a second end position (also referred to herein as "locking pin") and that is in sliding contact with the at least one contact spring, wherein the locking pin pushes the at least one contact spring in the direction of the receiving space for the plug-in contact to varying degrees depending on the position of the locking pin between the two end positions.

As a result of a varying position of the locking pin, a degree of a pressing force of the at least one contact spring on a plug-in contact that is inserted into the receiving space may be set easily and precisely. In this way, it is possible, for example in one position of the locking pin, to apply only low contact forces (including, if necessary, an absence of contact or zero contact) to the plug-in contact, which allows the plug-in contact to be easily inserted and pulled out. In another position of the locking pin, in contrast, very high contact forces can be exerted on the plug-in contact in a low-wear manner, whereby the plug-in contact can be pushed firmly onto the sleeve. In this way, a very high vibration resistance and a high level of performance can be achieved, for example. Depending on the position or the displacement distance of the locking pin relative to the sleeve, it is therefore possible to vary the contact force in a targeted manner. Moreover, such a contact part can be produced in a way that is compatible with various different plug connections in terms of the installation space. Such a contact part can be cost-effective to produce.

In embodiments of the present disclosure, differing contact forces can be implemented using the same sleeve by varying the contact spring and/or the pin. This simplifies cost-effective production. For example, the contact forces can be varied by a different thickness, shape and/or material of the contact spring(s). In addition or as an alternative, the contact forces can be varied, for example, by way of a different diameter of the locking pin.

For example, the contact spring may be thinner, for example between 1 and 2 mm, such as 1.2 mm, compared to the thickness of the plug-in contact. The contact spring may be bent in two sections in the direction of the receiving space. One of these sections can correspond to an end position of the locking pin, so that the force exerted on the contact spring by the locking pin in this end position is lower than in other positions, such as the other end position of the locking pin. The other end position of the locking pin may be between the two bent sections of the contact spring. The pressing pressure of the contact spring is therefore the greatest in the locking position.

In some embodiments, the contact spring provides for one of the bent sections, in particular the bent section not coming in contact with the locking pin, to be bent further into the receiving space than the other section. The section bent more strongly into the receiving space is used to generate the greatest or a portion of the pressing pressure, or the entire pressing pressure, of the contact spring on the plug-in contact.

In some embodiments, the mounting of the contact spring in the sleeve is implemented through planar, terminal bearing regions that are seated on the sleeve, wherein the bearing regions have or laterally frame a respective central recess, in which tabs of the sleeve can engage. In this way, a simple option of laterally fixing the contact spring is achieved.

In some embodiments, the contact part may be a first contact part of an electrical plug connection. The plug-in contact is then in particular the matching second contact part or contact mating part of the plug connection or a part thereof. The contact part may also be referred to as a sleeve contact or simply only as a contact. The contact part may be a female contact part, and the plug-in contact may then be a male contact part. However, the contact part is not limited to this design and may generally be a male contact part, a female contact part, or a combination thereof.

In some embodiments, the sleeve is open at least at the front so as to allow the plug-in contact to be inserted at the front. It may in particular be open on two sides (for example, at the front and at the back). The sleeve may be designed to be closed at the sides peripherally. The sleeve can also be referred to as a sleeve-shaped base part, base body, housing or cage. It may have a rectangular basic shape in a front view (in the insertion direction), having, for example, rounded corners.

In some embodiments, the locking pin projects through the sleeve (for example, perpendicularly to an insertion direction), may be guided by guide slots of the sleeve and/or may be grabbed from outside the sleeve. The locking pin may have a cylindrical basic shape, which has annular grooves in the region of the sleeve. Thus, as a result of a positive fit with the sleeve, for example, the locking pin can be prevented from sliding out laterally.

According to embodiments of the present disclosure, the sleeve is a formed metallic sheet metal part, in particular a stamped and bent part. This can keep the production costs low and allows high mechanical strength.

According to embodiments of the present disclosure, the at least one contact spring is held at least in a form-locked and/or force-fit manner. The contact spring may therefore be a component that is produced separately from the sleeve. For a form-locked mounting, for example, it may be surrounded terminally by bent regions of the sleeve (such as appropriate tabs). For this purpose, the contact spring may be placed against the sleeve and the sleeve then be regionally bent onto the contact spring. The production of the sleeve may therefore be independent of the production of the contact spring.

According to embodiments of the present disclosure, the contact spring, at least on the contact region thereof (also referred to herein as "sliding contact region") with the locking pin, is oriented obliquely with respect to a displacement direction of the locking pin. This allows a contact force on the plug-in contact to be set which continuously rises as the displacement distance increases. This is helpful in setting a value of the contact force in a simple manner by selecting the displacement distance or by a selected position of the locking pin.

In some embodiments, in the displacement direction of the locking pin in front of and/or behind the sliding contact region, the contact spring may include one or more contact regions projecting in the direction of the receiving space for the plug-in contact (also referred to herein as "pressure contact regions" or "bent sections") for making contact with the plug-in contact.

According to embodiments of the present disclosure, the at least one contact spring is made of steel, such as stainless steel. In this way, a large contact force may be exerted on the plug-in contact because steel has a considerably higher yield strength than precious metals such as copper, for example. As a result of the large contact force, it is also possible to considerably lower an electrical transition resistance between the plug-in contact and the contact part, and more particularly to a value that is practically no longer significant.

According to embodiments of the present disclosure, the sleeve may be made of steel, in particular stainless steel. Moreover, chemical reactions between the contact spring and the sleeve can therefore be prevented. Steel is also less expensive than copper and may help reduce costs.

According to some embodiments, to connect the contact part, for example, to a busbar, cable, or the like, the sleeve holds a plate-shaped contact tab at least in a form-locked manner, and the receiving space for the plug-in contact is located between the contact tab and the at least one contact spring. The contact tab then represents a part of the contact part. The plug-in contact is in particular pushed by the at least one contact spring onto the contact tab. The presence of the contact tab provides a particularly planar contact surface and therefore a particularly low transition resistance to the plug-in contact may be possible.

According to embodiments of the present disclosure, for easy form-locked securing in the sleeve, the contact tab has laterally projecting protrusions which engage in matching recesses or receiving holes of the sleeve. The engagement can be implemented, for example, by forming, in particular bending, a sheet metal part to obtain the finished sleeve having the contact tab placed thereon. The protrusions of the contact tabs engage in the receiving holes, for example at least two holes on the two sides of the sleeve, and securely hold the contact tab in the sleeve.

According to some embodiments for producing a plug connection having very low electrical resistance, the contact tab is made of copper, in particular electrolyte copper. The plug-in contact may also be made of copper to enable very low resistance.

According to some embodiments, to reduce a transition resistance between the contact tab and the plug-in contact and increase the vibration resistance, the contact tab has a protruding profile on the contact surface thereof with the plug-in contact. In this way, it is possible to substantially compensate for minor irregularities of the contact tab and/or of the plug-in contact. The profile may form an approximately rectangular plateau, which projects only slightly from the contact tab and narrows the receiving area within the sleeve over a large area. The height of the profile is only a fraction, in particular 0.1 to 0.5, of the thickness of the plug-in contact.

According to some embodiments, to reduce the transition resistance, the provided contact surface, in particular at least the profile, of the contact tab is silver-coated. However, in addition or as an alternative, the contact tab may also be surface-treated in a different manner, such as coated with gold, tin or zinc.

According to some embodiments, the sleeve has side edges that mutually engage with each other in a form-locked manner. In this way, a mechanically robust sleeve, in particular one that does not open, can be provided solely by way of forming. This allows avoiding welding or the like and enables the sleeve to remain flat at the butt edge.

According to some embodiments, the two butt edges have complementary undercut edge shapes, such as a meander-shaped edge shape.

Embodiments of the present disclosure provide a method for producing a contact part (in particular a sleeve thereof) in which a sheet metal part and at least one contact spring are provided. The at least one contact spring is held at least in a form-locked manner in the sheet metal part by forming the same, and the sheet metal part is then formed further to obtain a sleeve, which on the inside forms a receiving space for a plug-in contact to be inserted in the insertion direction. The method yields the same advantages as the above-described embodiments of the plug part and can have an analogous design.

According to some embodiments, the sheet metal part is formed in such a way that the butt edges thereof mutually engage in each other in a form-locked manner.

According to some embodiments, the forming operation brings a contact tab in engagement with the sheet metal part at least in a form-locked manner.

According to some embodiments, a locking pin is placed through the sheet metal part that has been bent to obtain a sleeve.

The properties, features and advantages of the present disclosure as described, and the manner in which these are achieved, will become more apparent and understandable in connection with the following detailed description, which will be described in more detail in connection with the drawings. The foregoing general description and the following detailed description are exemplary and explanatory only, and are not restrictive of embodiments consistent with the present disclosure. Further, the accompanying drawings illustrate embodiments of the present disclosure, and together with the description, serve to explain principles of the present disclosure.

DETAILED DESCRIPTION

Figure 1:
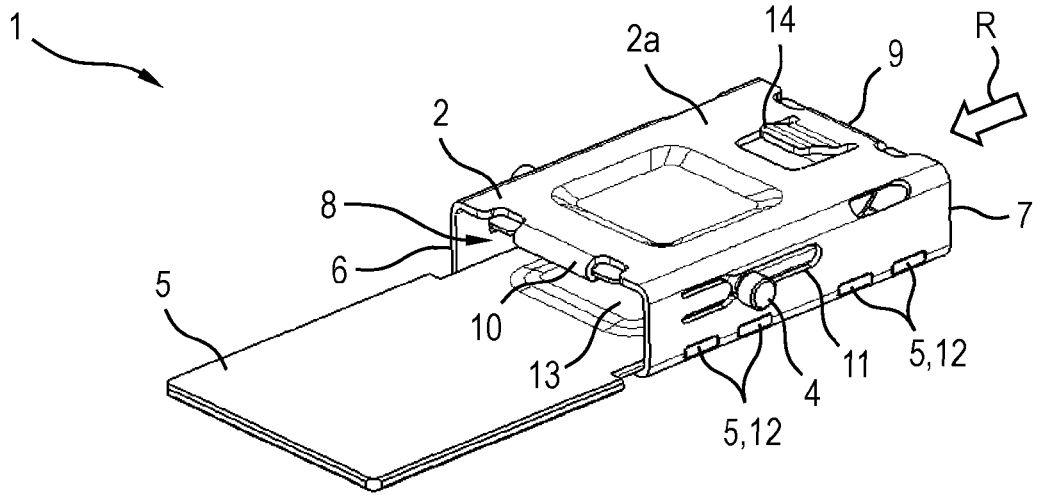
FIG. 1 shows an exemplary contact part according to the disclosure in a view obliquely from behind.
Figure 2:
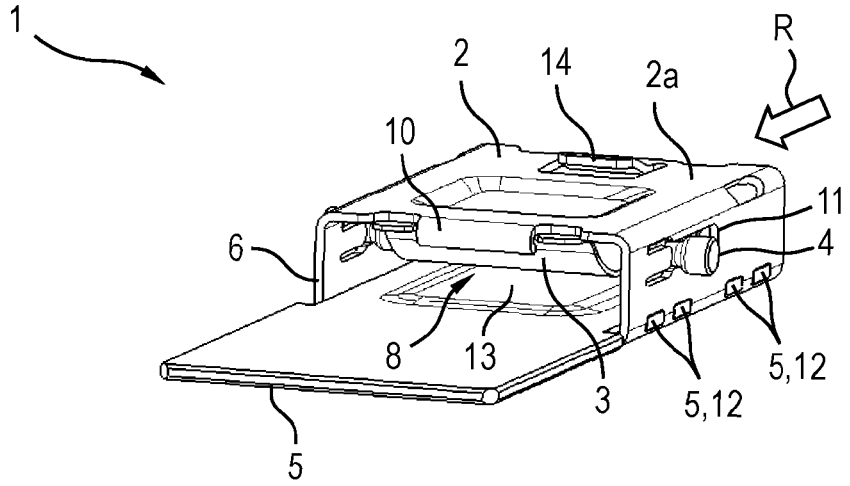
FIG. 2 shows an exemplary contact part according to the disclosure in a further view obliquely from behind.
Figure 3:
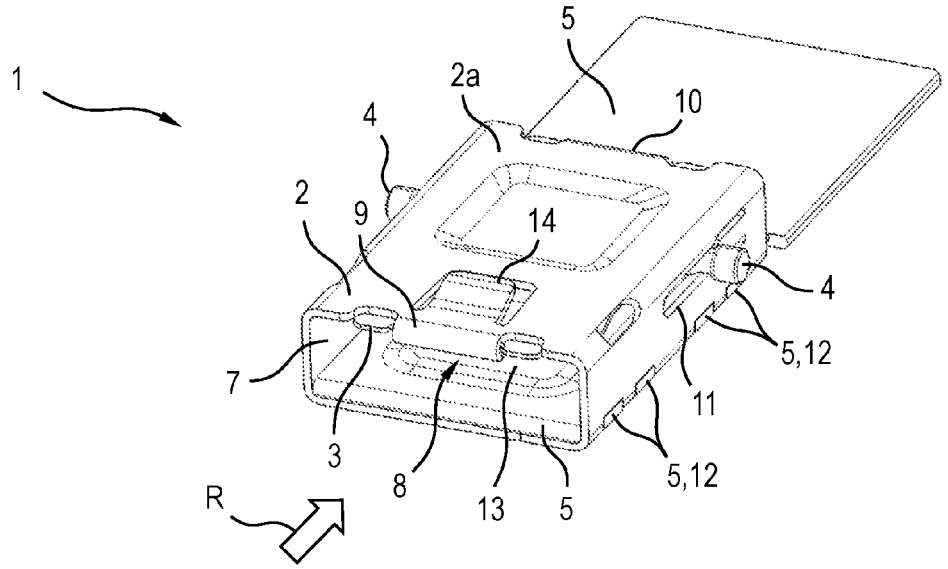
FIG. 3 shows an exemplary contact part according to the disclosure in a view obliquely from the front.
Figure 4:
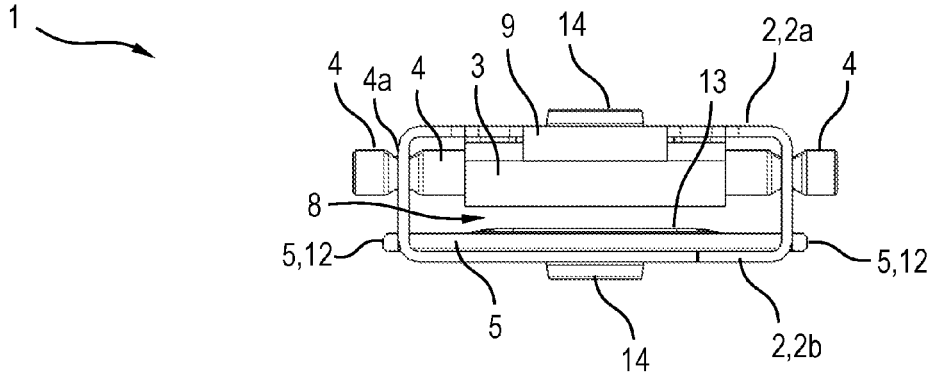
FIG. 4 shows a frontal view of an exemplary contact part according to the disclosure.

FIG. 1 shows an exemplary contact part 1 in a view obliquely from behind. FIG. 2 shows the contact part 1 in a further view obliquely from behind. FIG. 3 shows the contact part 1 in a view obliquely from the front. FIG. 4 shows a frontal view of the contact part 1.

The contact part 1 has a four-piece design (for example, it may be assembled from four separately produced individual parts), comprising a sleeve 2, a contact spring 3 (see FIG. 2 and FIG. 5), a locking pin 4 (see also FIG. 6), and a plate-shaped, in particular strip-shaped, contact tab 5.

Figure 7:
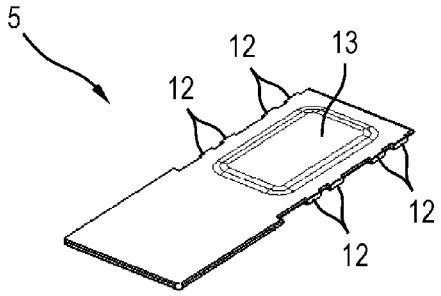
FIG. 7 shows an exemplary contact tab of the contact part according to the disclosure in a view obliquely from behind.

The sleeve 2 is closed at the sides peripherally and has an open back side 6 as well as an open front side 7. The front side 7 is provided for inserting a plug-in contact K (see FIG. 7), for example in an insertion direction indicated by R in FIG. 1. The insertion direction R extends on or parallel to a longitudinal axis (not illustrated) of the sleeve 2. In a front view perpendicular to the insertion direction R (see in particular FIG. 4), the sleeve 2 has a rectangular basic shape having rounded edges. On the inside, the sleeve 2 provides a receiving space 8 for the plug-in contact K to be inserted in the insertion direction R.

Figure 5:
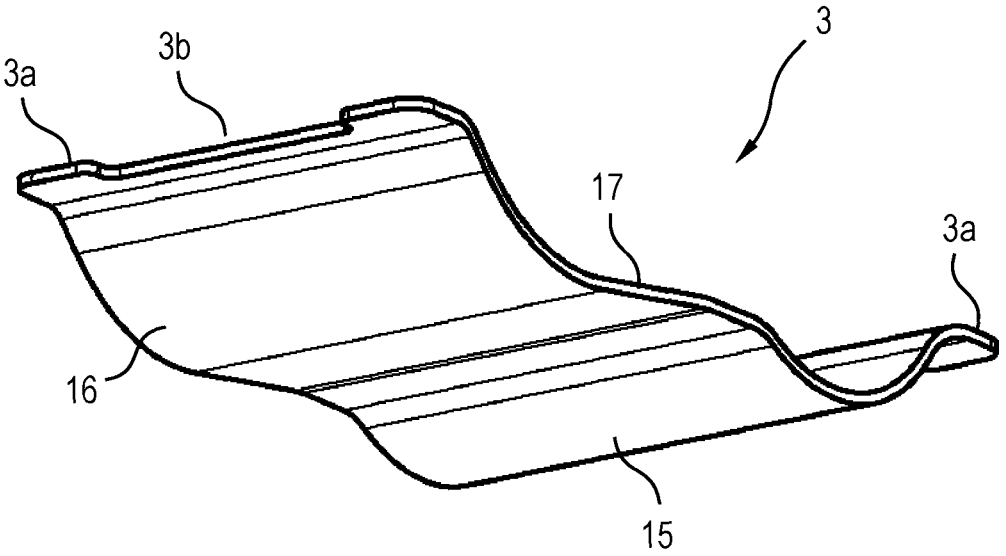
FIG. 5 shows an exemplary contact spring of the contact part according to the disclosure in a view obliquely from beneath.

The contact spring 3 shown on its own in FIG. 5 may be, for example, strip-shaped. The contact spring 3 is secured on the inside to an upper side 2*a* of the sleeve 2, and more particularly by engaging at the ends in a front tab 9 that is turned inward and a rear tab 10 that is turned inward. In this way, the contact spring 3 is held on the sleeve 2 at least in a form-locked manner.

The contact spring 3 can be seated on the sleeve 2 with planar terminal bearing regions 3*a*, wherein the bearing regions 3*a* have or laterally frame a respective central recess 3*b* in which the tabs 9 and 10 can engage. In this way, a simple option of laterally fixing the contact spring 3 is achieved.

The locking pin 4 can be displaced parallel to the insertion direction R in a guide formed by slots 11 in the sleeve 2. Ends of the slots 11 form stops and therefore end positions for the locking pin 4. The figures show the locking pin 4 on a stop at the back side corresponding to a first end position. Between the two end positions, the locking pin 4 is in sliding contact with an upper side of the contact spring 3 at least in sections. During the displacement in the slots 11, it therefore slides across the upper side of the contact spring 3.

Figure 6:
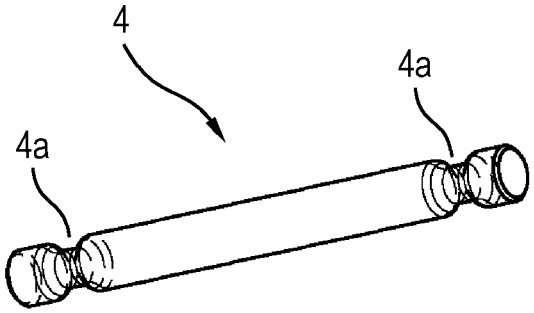
FIG. 6 shows an exemplary locking pin of the contact part according to the disclosure in an oblique view.

The locking pin 4 shown on its own in FIG. 6 may have a cylindrical shape, including respective annular grooves 4*a* in the sections in which the locking pin 4 slides in the slots 11. The annular grooves 4*a* prevent the locking pin 4 from sliding laterally out of the slots 11 because the edges of the slots 11 are able to engage loosely in the annular grooves 4*a*.

Depending on the position along the slots 11, the locking pin 4 displaces the contact spring 3 to a varying degree downward in the direction of the contact tab 5.

The receiving space 8 is therefore located between the contact tab 5 and the contact spring 3. If no plug-in contact K is located in the receiving space 8, a distance between the contact spring 3 and the contact tab 5 is set by the position of the locking pin 4. However, if a plug-in contact K is located in the receiving space 8, the position of the locking pin 4 can be used to at least sectionally set a contact force or a contact pressure of the contact spring 3 on the plug-in contact K, and therefore of the plug-in contact K on the contact tab 5.

The sleeve 2, the spring 3 and the locking pin 4 may be made of stainless steel, which is robust and rigid compared to the elements of the copper group, such as tin, zinc or aluminum. In this way, a large contact force can be applied without one of the sleeve 2, the spring 3, and the locking pin 4 undergoing plastic deformation. The contact tab 5, in contrast, may be made of copper or a copper alloy. The contact tab 5 may be surface-treated, such as mechanically surface-treated or chemically surface-treated. The surface treatment may include a coating.

The sleeve 2 also holds the contact tab 5 at least in a form-locked manner. For this purpose, the contact tab 5 comprises four respective protrusions 12 on each of the two side edges thereof, as is also shown in more detail in FIG. 7. During the forming operation of a sheet metal part B (see FIG. 10) to obtain the sleeve 2, the protrusions 12 engage with matching recesses of this sheet metal part. As a result, for example, welding, adhesive bonding and the like of the contact tab 5 to the sleeve 2 may not be needed.

The contact tab 5 may have a projecting profile 13 on the contact surface thereof with the plug-in contact K, the surface of the profile being silver-coated.

As is shown in FIG. 3, the sleeve 2 moreover comprises an obliquely outwardly projecting detent tab 14 on the upper side 2*a* thereof and on a bottom side 2*b* for latchingly engaging the sleeve 2 in a housing (not illustrated).

Figure 8:
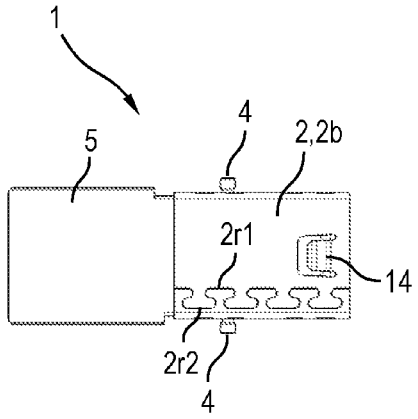
FIG. 8 shows an exemplary contact part according to the disclosure from beneath.

As is shown in FIG. 8, the sleeve 2 comprises side edges 2*r*1, 2*r*2 that mutually engage in each other in a form-locked manner. The side edges 2*r*1, 2*r*2 may be shaped in a complementary meander-shaped manner to obtain a positive fit. With this positive fit, welding, adhesive bonding or the like of the side edges 2*r*1, 2*r*2 is not needed. Alternatively, a particularly robust weld seam, adhesive joint or the like is provided. The side edges 2*r*1, 2*r*2 can therefore be welded, adhesively bonded or the like to each other, but do not have to be. Because the contact tab 5 covers the side edges 2*r*1, 2*r*2 on the inside, it is also not possible to push the side edges 2*r*1, 2*r*2 readily apart.

Figure 9:
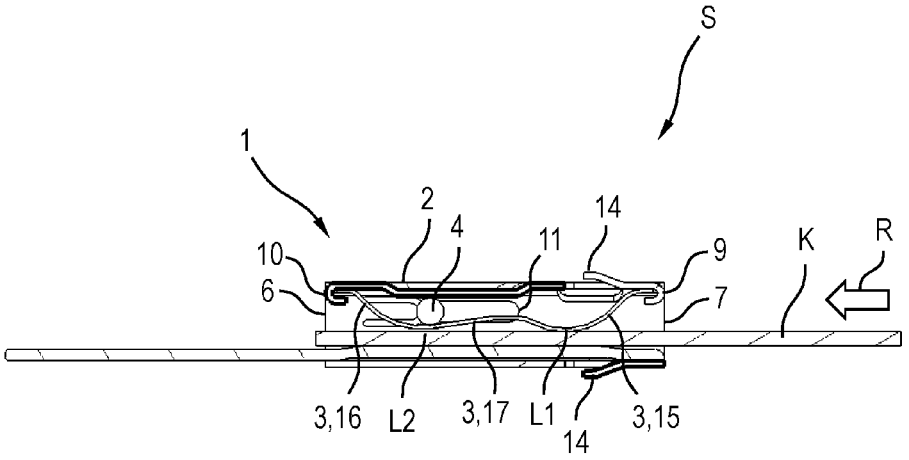
FIG. 9 shows an exemplary plug connection between the contact part according to the disclosure and an exemplary plug-in contact inserted therein as a sectional illustration in a side view.

FIG. 9 shows a plug connection S between the contact part 1 and a plug-in contact K inserted therein as a sectional illustration in a side view.

The contact spring 3 is curved multiple times in the longitudinal section (along the insertion direction R), such that, at the front and the back proceeding from the tabs 9 and 10, it has sections 15 and 16 which are each oriented in the direction of the plug-in contact K and of the contact tab 5 and serve as pressure contact regions. Between sections 15 and 16 an intermediate section 17 is located, which is oriented in the direction of the top side 2*a* and serves as a sliding contact region. The sections 15 and 16 have lowermost lines of the contact spring 3 which can form a respective contact line L1 and L2 with the upper side of the plug-in contact K when the same is inserted. In more general terms, at least one of the section 15 or section 16 is able to form a contact line L1 or L2. This can also be referred to as a strip-like, in particular corrugated, shape.

The intermediate section 17 may be located at the same longitudinal position as the slots 11 in which the locking pin 4 can be guided. Consequently, the locking pin 4 essentially only slides on the intermediate section 17. The intermediate section 17 extends obliquely, so that it is continuously displaced to varying degrees depending on the position of the locking pin 4. Here, the intermediate section 17 has a largest distance from the slot 11 in a first (shown as the left) end position or end position in which the locking pin 4 is located. In the first end position, a displacement of the contact spring 3, and consequently also the pressure on the plug-in contact K, is therefore the lowest. The shown first end position may in particular be suitable for inserting the plug-in contact K into the contact part 1 with little effort. In some embodiments, it is possible to implement a zero contact position in this way.

When the locking pin 4 is pushed into the second end position thereof (corresponding to the movement thereof from left to right as shown), the intermediate section 17 is increasingly strongly displaced in the direction of the plug-in contact K and therefore exerts an ever greater pressure force on the same. The highest pressure force is reached in the second (shown as the right) end position.

For displacement purposes, the locking pin 4 has two end sections which project laterally from the slots 11 of the sleeve 2 and at which it can be grabbed.

Figure 10:
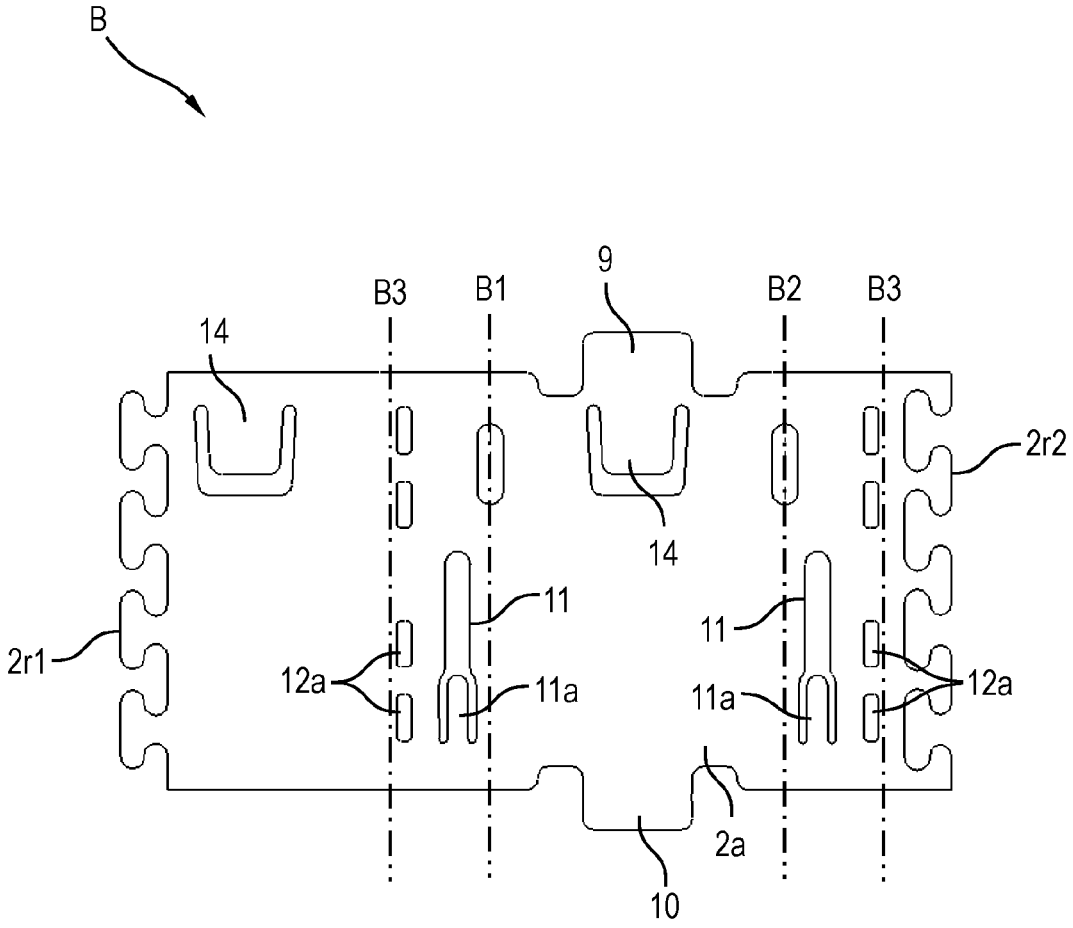
FIG. 10 shows a sheet metal part for producing an exemplary sleeve of the contact part according to the disclosure in the unfolded state.

FIG. 10 shows a sheet metal part B, for producing the exemplary sleeve 2 of the contact part 1, in the unrolled state. By way of bending along parallel bending lines B1 to B4, the sleeve 2 is formed from the sheet metal part B. For a simplified description, the respective functional regions of the sheet metal part B are denoted by the reference numerals of the corresponding functional regions of the sleeve 2.

The sheet metal part B comprises the following functional regions: the tabs 9 and 10, the slots 11, tabs 11 a for inserting the locking pin 4 into the slots 11, the detent tabs 14, receiving holes 12*a* for receiving the protrusions 12 of the contact tab 5, and the side edges 2*r*1, 2*r*2.

To produce the sleeve 2 of the contact part 1, initially the sheet metal part B and the contact spring 3 are provided. Subsequently, the contact spring 3 (not shown) is placed with the bearing regions 3*a* thereof on the inside of the future upper side 2*a* of the sleeve 2. Then, the tabs 9 and 10 are formed inward by way of bending, in particular in a folded manner, so as to hold the contact spring 3 at least in a form-locked manner.

Thereupon, the tabs 11 a are bent over outward and thereafter the sheet metal part B is bent over inward perpendicularly along the bending lines B1 and B2. The detent tabs 14 are also bent or angled obliquely outward. The locking pin 4 can then be placed into the openings exposed by the tabs 11 a and inserted further into the slots 11. The tabs 11 a can then again be bent into the openings, so that they serve as stops for the locking pin 4, which can now no longer slide out of the slots 11.

The sheet metal part B can be bent over inward perpendicularly along the bending lines B3 and B4, and more particularly so that the protrusions 12 of the contact tab 5 engage in the receiving holes 12*a*. The contact tab 5 is thereby held by the sheet metal part B in a form-locked manner. As a result of this bending along the bending lines B3 and B4, additionally the side edges 2*r*1 and 2*r*2 are engaged with each other in a form-locked manner and can then be welded to each other, for example.

It is not necessary for the method steps to be carried out in the order listed by way of example.

In some embodiments, the locking pin can also be passed through after a later method step or as a last method step.

In some embodiments, it is also possible to omit the tabs 11*a*, such as when the locking pin is inserted into the slots 11 as a stud and press-fit stemmed at the ends.

In general, "a," "an" or the like may be understood to mean a singular or a plural form, in particular within the meaning of "at least one" or "one or more" or the like, unless this is explicitly excluded, such as by the expression "exactly one" or the like.

While the present disclosure is illustrated and described in detail according to the above embodiments, the present disclosure is not limited to these embodiments and additional embodiments may be implemented. Further, other embodiments and various modifications will be apparent to those skilled in the art from consideration of the specification and practice of one or more embodiments disclosed herein, without departing from the scope of the present disclosure.

LIST OF REFERENCE NUMERALS

1 contact part
2 sleeve
2*a* upper side of the sleeve 2
2*b* bottom side of the sleeve 2
2*r*1 side edge
2*r*2 side edge
3 contact spring
3*a* bearing region
3*b* recess
4 locking pin
4*a* annular groove
5 contact tab
6 open back side
7 open front side
8 receiving space
9 tab
10 tab
11 slot
11*a* tab
12 protrusion
12*a* receiving holes
13 profile
14 detent tab
15 section
16 section
17 intermediate section
B sheet metal part
B1-B4 bending line
K plug-in contact
L1 contact line
L2 contact line
R insertion direction
S plug connection

What is claimed is:

1. A contact part, comprising:

a sleeve enclosing a receiving space;

a contact spring secured to an inside of the sleeve, the contact spring including one or more planar terminal bearing regions configured to mount the contact spring in the sleeve, each of the one or more planar terminal bearing regions having a central recess; and a locking pin configured to:

be displaceably guided in the sleeve between a first end position and a second end position, be in sliding contact with the contact spring, and push the contact spring towards the receiving space to a degree depending on a position of the locking pin between the first and second end positions.

2. The contact part according to claim 1, wherein the sleeve is a formed sheet metal part configured to hold the contact spring in at least a form-locked or form-fit manner.

3. The contact part according to claim 1, wherein the contact spring is made of steel or includes steel.

4. The contact part according to claim 1, wherein the contact spring includes a first bent section and a second bent section bent towards the receiving space.

5. The contact part according to claim 4, wherein:

the first bent section corresponds to the first end position, and the locking pin exerts a lower force on the contact spring in the first end position than in the second end position.

6. The contact part according to claim 5, wherein the second end position is arranged between the first and second bent sections.

7. The contact part according to claim 4, wherein the second bent section is bent further into a lower portion of the receiving space than the first bent section.

8. The contact part according to claim 1, further comprising:

a plate-shaped contact tab held in the sleeve in at least a form-locked manner, wherein the receiving space is located between the contact tab and the contact spring.

9. The contact part according to claim 8, wherein the contact tab has a projecting profile on a surface of the contact tab.

10. The contact part according to claim 9, wherein the contact tab is made of copper, and the projecting profile is silver-coated.

11. The contact part according to claim 8, wherein the sleeve includes one or more receiving holes configured to cooperate with one or more protrusions in the plate-shaped contact tab.

12. The contact part according to claim 1, wherein the sleeve includes a plurality of side edges configured to mutually engage with each other in a form-locked manner.

13. A method for producing a contact part, comprising:

providing a sheet metal part and a contact spring, wherein the sheet metal part includes a tab and the contact spring includes a planar terminal bearing region having a central recess;

bending the tab to hold the contact spring against the sheet metal part in at least one of a form-locked manner or a force-fit manner, the tab engaging the central recess; and bending the sheet metal part to form a sleeve that encloses a receiving space, wherein the contact spring is secured inside the sleeve.

14. The method according to claim 13, wherein:

the sheet metal part further includes one or more butt edges, and bending the sheet metal part to form the sleeve includes engaging the one or more butt edges with each other in a form-locked manner.

15. The method according to claim 13, wherein bending the sheet metal part to form the sleeve further includes engaging a contact tab with the sheet metal part in at least a form-locked manner.

16. A high-current connection system for a vehicle, comprising:

a sleeve enclosing a receiving space for inserting a plug-in contact;

a contact spring secured to an inside of the sleeve;

a plate-shaped contact tab held in the sleeve in at least a form-locked manner, the receiving space being located between the contact tab and the contact spring; and a locking pin configured to:

be displaceably guided in the sleeve between a first end position and a second end position, be in sliding contact with the contact spring, and push the contact spring towards the receiving space to a degree depending on a position of the locking pin between the first and second end positions.

17. The system according to claim 16, wherein the sleeve is a formed sheet metal part configured to hold the contact spring in at least a form-locked or form-fit manner.

18. The system according to claim 16, wherein:

the contact spring includes a first bent section and a second bent section bent towards the receiving space;

the first bent section corresponds to the first end position, and the locking pin exerts a lower force on the contact spring in the first end position than in the second end position.

19. The system according to claim 18, wherein the second end position is arranged between the first and second bent sections.

20. The system according to claim 16, wherein the contact spring comprises one or more planar terminal bearing regions configured to mount the contact spring in the sleeve, each of the one or more planar terminal bearing regions having a central recess.

* * * * *